US006413917B1

(12) United States Patent
Yamada et al.

(10) Patent No.: US 6,413,917 B1
(45) Date of Patent: Jul. 2, 2002

(54) EXTREME-PRESSURE ADDITIVE, PROCESS FOR PRODUCING THE SAME, CUTTING FLUID, AND GRINDING FLUID

(75) Inventors: Shigeru Yamada, Kashima; Kazumasa Ibi, Kashima-gun, both of (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 09/787,772

(22) PCT Filed: Jul. 21, 2000

(86) PCT No.: PCT/JP00/04872

§ 371 (c)(1),
(2), (4) Date: Jun. 15, 2001

(87) PCT Pub. No.: WO01/05916

PCT Pub. Date: Jan. 25, 2001

(51) Int. Cl.[7] ..... C10M 135/02; C10M 173/02
(52) U.S. Cl. ..... 508/324; 508/331; 72/42
(58) Field of Search ..... 508/331, 324

(56) References Cited

U.S. PATENT DOCUMENTS

| | | | | |
|---|---|---|---|---|
| 4,119,550 A | | 10/1978 | Davis et al. | 508/324 |
| 4,148,738 A | * | 4/1979 | Liston et al. | 252/32.7 E |
| 4,217,233 A | | 8/1980 | Michaelis | 508/299 |
| 4,260,503 A | | 4/1981 | Michaelis | 508/501 |
| 4,560,488 A | * | 12/1985 | Vinci | 252/33 |
| 5,028,345 A | * | 7/1991 | Everett et al. | 252/32.7 E |
| 5,164,102 A | * | 11/1992 | Everett et al. | 252/32.7 E |
| 5,391,310 A | * | 2/1995 | Krueger et al. | 252/45 |
| 5,595,965 A | | 1/1997 | Wiggins | 508/491 |

FOREIGN PATENT DOCUMENTS

| | | |
|---|---|---|
| DE | 0 001 217 | 4/1979 |
| DE | 28 38 981 | 3/1980 |
| EP | 0 652 271 A1 | 5/1995 |
| EP | 0 806 470 A2 | 11/1997 |
| FR | 2 434 864 | 3/1980 |
| JP | 54-46704 | 4/1979 |
| JP | 55-38819 | 3/1980 |
| JP | 61-183392 | 8/1986 |
| JP | 10-46181 | 2/1998 |

* cited by examiner

*Primary Examiner*—Ellen M. McAvoy
(74) *Attorney, Agent, or Firm*—Armstrong, Westerman & Hattori, LLP

(57) ABSTRACT

The present invention provides a sulfur-based extreme-pressure additive that is completely soluble in water without using a surfactant, and has satisfactory odor and hue. In addition, the present invention provides a cutting liquid and grinding liquid having superior defoaming property and rust preventive characteristics, while also having high load resistance and lubrication performance comparable to cutting oils and grinding oils of the prior art. The above objects are achieved by an extreme-pressure additive comprising the salt of a condensation product of a sulfurized hydroxy-unsaturated fatty acid, the condensation product having a sulfur content of 8 to 15% by weight (mass), color of 6 or less, and acid value of 80 to 200, and a grinding liquid comprising that extreme-pressure additive and water.

9 Claims, No Drawings

EXTREME-PRESSURE ADDITIVE, PROCESS FOR PRODUCING THE SAME, CUTTING FLUID, AND GRINDING FLUID

TECHNICAL FIELD

The present invention relates to a water-soluble extreme-pressure additive and its production method.

BACKGROUND ART

Various oil agents have conventionally been used to prepare liquids for cutting or grinding metal, and water-soluble oil agents have been used particularly preferably due the advantages resulting from using water for their medium, namely cooling effects, incombustibility, economics and low level of environmental contamination. However, water-soluble oil agents have problems in terms of their metal machining performance such as decreased finished surface accuracy and tool service life due to insufficient load resistance and insufficient friction reducing effects and other factors relating to lubricating performance. Moreover, they also have problems characteristic of water-soluble oil agents such as foaming during use, rust formation, decay and foul odor. Various improvements have been attempted in the past to remedy these characteristic problems.

In order to impart greater load resistance, extreme-pressure additives that are virtually insoluble in water are used, examples of which include emulsion-type oil agents in which a chlorine-based extreme-pressure additive such as chlorinated paraffin or chlorinated fatty acid ester, or as described in Japanese Unexamined Patent Application, First Publication No. Hei 7-157793, a sulfur-based extreme-pressure additive such as a sulfurized resin, sulfurized olefin or dialkylpolysulfide, is dispersed in water using a large amount of surfactant. However, the extreme-pressure performance of emulsion-type oil agents is inadequate, management of liquid in the emulsion state is bothersome, and there are environmental problems including contamination by the oil component due to breakdown of the emulsion and the need to wash machined products with solvent and so forth.

Attempts have also been made to produce soluble oil agents using sulfurized, long-chain unsaturated fatty acid salts like the alkanol amine salt of sulfurized oleic acid as examples of solubilization with a sulfur-based extreme-pressure additive. However, although extreme-pressure performance is high, this has disadvantages including difficulty in achieving complete solubilization unless a surfactant is used, potent odor and violent foaming.

Soluble oil agents using other extreme-pressure additives include the use of di-(2-hydroxyethyl)disulfide as described in U.S. Pat. No. 4,250,046, the use of an alkanol amine salt of 3-mercaptopropionic disulfide described in Japanese Unexamined Patent Application, First Publication No. Sho 63-284294, and the use of an alkanol amine salt of alkylthiopropionic acid described in Japanese Unexamined Patent Application, First Publication No. Hei 5-43886. However, none of these are adequate for improving extreme-pressure performance and lubricating performance.

Examples of soluble oil agents not containing sulfur include the alkaline metal or amine salt of a condensation product of ricinoleic acid described in Japanese Examined Patent Application, Second Publication No. Sho 60-49677 and Japanese Examined Patent Application, Second Publication No. Hei 2-5799, and the alkaline metal salt or amine salt of a condensation product of a hydroxy long-chain fatty acid described in Japanese Unexamined Patent Application, First Publication No. Hei 7-97590. Both of these offer excellent odor, defoaming property, decay resistance and rust prevention. However, they have the disadvantage of extreme-pressure performance being considerably low as compared with sulfur-based extreme-pressure additives.

DISCLOSURE OF THE INVENTION

In consideration of the actual circumstances as described above, the object of the present invention is to provide an extreme-pressure additive having excellent load resistance and lubricating performance while also having satisfactory odor, defoaming property and rust prevention.

As a result of conducting various studies to achieve this object, the inventors of the present invention found that, instead of using for the extreme-pressure additive the condensation product of a hydroxy-unsaturated fatty acid itself, by crosslinking the unsaturated double bonds within the molecule with sulfur to introduce a sulfur-crosslinked structure into the molecule, and forming the salt of a sulfurized, condensed hydroxy-unsaturated fatty acid, an extreme-pressure additive can be obtained having excellent performance.

In addition, it was also found that in the case of using ricinoleic acid for the hydroxy-unsaturated fatty acid, a salt of condensed ricinoleic acid, having a sulfur-crosslinked structure in its molecule resulting from reacting ricinoleic acid with sulfur and hydrogen sulfide at a comparatively low temperature, has the best characteristics as a water-soluble extreme-pressure additive, namely excellent load resistance, lubricating performance, complete solubility, odor, defoaming property and rust prevention, thereby leading to completion of the present invention.

Namely, the present invention is an extreme-pressure additive comprising the salt of a condensation product of a sulfurized hydroxy-unsaturated fatty acid having a specific sulfur content, specific color and specific acid number.

BEST MODE FOR CARRYING OUT THE INVENTION

In the present invention, typical examples of salts of condensation products of sulfurized hydroxy-unsaturated fatty acids include those having all of the following compositions in terms of chemical structure:

(X) the hydroxy-unsaturated fatty acid has a condensed structure (ester bond);

(Y) the hydroxy-unsaturated fatty acid has a sulfur-crosslinked structure in which a sulfur atom is added to a carbon-carbon unsaturated double bond within the molecule based on a hydroxy-unsaturated fatty acid; and, (Z) a carboxyl group based on a hydroxy-unsaturated fatty acid has a salt structure and is contained in the molecule of the condensation product.

Furthermore, a hydroxy-unsaturated fatty acid refers to that having a hydroxyl group, carbon-carbon unsaturated double bond and carboxyl group within its molecule.

Although the salt of the condensation product of the sulfurized hydroxy-unsaturated fatty acid may be obtained by reacting in any order, it is preferable that the condensation product of a sulfurized hydroxy-unsaturated fatty acid be obtained first, followed by its conversion to a salt. In the obtaining of the condensation product of the sulfurized hydroxy-unsaturated fatty acid of the previous stage, the hydroxy-unsaturated fatty acid may be sulfurized while condensing followed by the introduction of an ester bond structure and sulfur-crosslinked structure into its molecule.

This method is preferable because it is able to improve productivity as a result of having few production steps and so forth, while also allowing a sulfur-crosslinked structure to be easily introduced into the molecule.

In addition, as an example of a specific method, hydroxy-unsaturated fatty acid, sulfur and hydrogen sulfide are condensed together with sulfurizing the hydroxy-unsaturated fatty acid in the presence of a catalyst as necessary while heating and applying pressure at a comparatively low temperature.

This method is preferable since controlling the reaction, including the sulfur content and so forth, is easier, the resulting product is colored less and there is less odor. It is preferable to select the reaction temperature to be higher than 100° C. but not higher than 150° C., and the reaction time to be within the range of 1–20 hours. Since this method can be carried out at a comparative low pressure and comparative low temperature, it is also preferable since the amount of energy consumed per unit production volume can be reduced, and the reaction can be carried out in a reaction vessel having ordinary pressure resistance.

Although the acid value of the condensation product of the sulfurized hydroxy-unsaturated fatty acid is 80–200 mg KOH/g, and particularly 100–160 mg KOH/g, this is preferable in that it offers both excellent lubricating performance and stable water solubility without using a surfactant. This applies similarly to the case of an optimum condensation product of sulfurized ricinoleic acid to be described later. Furthermore, although the condensation product of the sulfurized hydroxy-unsaturated fatty acid can be made dispersible in water instead of making it soluble in water by forming a salt of the condensation product of the sulfurized hydroxy-unsaturated fatty acid, being able to dissolve in water results in excellent stability.

Next, the following provides an explanation of the raw materials for obtaining a condensation product of a sulfurized hydroxy-unsaturated fatty acid.

Although there are no limitations on the number of hydroxyl groups or number of carboxyl groups within the molecule of the hydroxy-unsaturated fatty acid, both numbers are preferably from 1 to 3. It is preferable that the carbon chain length of the hydroxy-unsaturated fatty acid be long, namely 12–30 carbons, and preferably 14–20 carbons, including the carbons of unsaturated double bonds.

Examples of such hydroxy-unsaturated fatty acids include monohydroxy-unsaturated fatty acids such as 12-hydroxyoleic acid (ricinoleic acid), 13-hydroxyoleic acid and 15-hydroxyoleic acid, and dihydroxy-unsaturated fatty acids such as 9,10-dihydroxyoleic acid, 9,10-dihydroxylinoleic acid, 12,13-dihydroxyoleic acid, 15,16-dihydroxylinoleic acid and 9,10-dihydroxpalmitoleic acid. These may be used alone as one type, or two or more types may be used in combination. 12-hydroxyoleic acid (ricinoleic acid) is the most preferable in consideration of performance, economics and so forth as an oil agent.

Ordinary commercially available products can be used for the hydroxy-unsaturated fatty acid and hydrogen sulfide in the present invention. Sulfur may be used either as in solid form or as a molten sulfur.

The catalyst used in the production method of the present invention is normally a basic catalyst. Amines such as alkyl amines, aryl amines, polyamines and alkanol amines are suitable amines that have good reactivity. Specific examples of these amines include butylamine, dibutylamine, tributylamine, n-octylamine, tert-octylamine, dioctylamine, tert-dodecylamine, tert-tetradecylamine, tert-hexadecylamine, tert-octadecylamine, dicyclohexylamine, arylamine, hexamethylenetetramine and triethanolamine.

The amount of sulfur contained in the extreme-pressure additive of the present invention is, for example, 8–15% by weight (mass), and preferably 9–11% by weight (mass) with respect to having both superior extreme-pressure performance and low decay.

Although the charging ratios of the raw materials (based on weight (mass)) may be changed as desired according to the required content of sulfur and so forth, at a total sulfur content of 9–11%, it is preferable that the hydroxy-unsaturated fatty acid content be 80–90%, sulfur content 6–7%, sulfur hydroxide content 3–4% and catalyst content 0.2–0.6%.

Although a method in which hydrogen sulfide gas is blown into an autoclave containing hydroxy-unsaturated fatty acid, sulfur and catalyst, or a method in which hydroxy-unsaturated fatty acid, sulfur, liquefied hydrogen sulfide and catalyst are charged all at once and allowed to react, may be used for the reaction form according to the production method of the present invention, the former method is preferable since the reaction can be carried out at a comparatively low pressure.

Although there are no particular restrictions on the pressure conditions of the reaction, they are preferably selected from, for example, 98–2940 kPa (1–30 kg/cm$^2$), in the case of the former method in which hydrogen sulfide gas is blown in, since the reaction can be carried out at 98–980 kPa (1–10 kg/cm$^2$), this method is preferable in terms of safety.

The reaction temperature in the production method of the present invention is relatively low in comparison with sulfurization performed with sulfur only using the same hydroxy-unsaturated fatty acid. Although there are no particular restrictions on the reaction temperature in the production method of the present invention according to the type of hydroxy-unsaturated fatty acid to be sulfurized and esterified, it can normally be selected from a range of 100–200° C. In the case of blowing in hydrogen sulfide, hydrogen sulfide is blown in so that the hydrogen sulfide is consumed in successive reactions within the reaction system as much as possible. In the production method of the present invention, the use of high-temperature reaction conditions at which the condensation reaction proceeds far ahead of the sulfurization reaction is not preferable.

The product of sulfurization and condensation of hydroxy-unsaturated fatty acid obtained with the production method of the present invention has a feint color. The color of the condensation product of sulfurized hydroxy-unsaturated fatty acid in the present invention refers to the color when measured in accordance with ASTM-D-1500. The color of the above condensation product in the present invention is 6 or less, and preferably 4 or less.

In the case of using ricinoleic acid for the hydroxy-unsaturated fatty acid, the temperature in the production method of the present invention is 100–160° C., and preferably 100–140° C. If below 100° C., the reaction proceeds slowly, and if above 140° C., the condensation reaction of ricinoleic acid, which is a competitive reaction with the sulfur crosslinking reaction, proceeds excessively, resulting in increased susceptibility to decreased water solubility while also tending to make color and odor poor, thereby making this undesirable. The reaction time can be adjusted within the range of 2–18 hours. The condensation product of ricinoleic sulfide is obtained in this manner.

The acid value of condensation products of sulfurized hydroxy-unsaturated fatty acids represented by the condensation product of ricinoleic sulfide can be changed according to the degree of the competing reaction in the form of the condensation reaction, can be adjusted with reaction temperature and reaction time, and is adjusted to the preferable range indicated below. As previously described, if the acid value is less than 10, viscosity increases easily and water solubility decreases, while if the acid value exceeds 160, the effect of lubricating performance decreases easily.

In the obtaining of a salt of the condensation product of sulfurized hydroxy-unsaturated fatty acid, for example, a carboxyl group contained in the molecule of the product is converted to salt by neutralizing with base in an arbitrary step for obtaining that salt. As one example of such a step, the condensation product of sulfurized hydroxy-unsaturated fatty acid is neutralized with base to obtain the salt of the condensation product of sulfurized hydroxy-unsaturated fatty acid. The ion-dissociated state of this salt greatly contributes to stable water solubility. As a result, since the surfactant that was required to impart stable solubility and dispersivity in the prior art can be eliminated or only used in an extremely small amount, the shortcomings in terms of performance in the case of using surfactant can be improved considerably.

Condensation products of sulfurized hydroxy-unsaturated fatty acids represented by the condensation product of ricinoleic sulfide form a salt with base. Although examples of base include inorganic bases such as metal hydroxides, metal carbonates and ammonia as well as organic amines such as aliphatic primary amines, aliphatic secondary amines and aliphatic tertiary amines, preferable examples consist of hydroxides of alkaline metals and alkanol amines, resulting in the formation of alkaline metal salts or alkanol amine salts.

Examples of alkaline metal hydroxides that can be used include sodium hydroxide and potassium hydroxide, while examples of alkanol amines that can be used include various types such as the mono-, di- and tri- forms of ethanolamine, propanolamine, butanolamine and octanolamine. Only one type of these may be used or two or more types may be used in combination. Particularly preferable examples of bases include the mono-, di- and tri- forms of ethanolamine.

Although said salts of condensation products of sulfurized hydroxy-unsaturated fatty acids represented by the salt of a condensation product of ricinoleic sulfide can be converted to said salt by mixing the above hydroxide of an alkaline metal or alkanol amine, using a high equivalent ratio of 1–3 results in satisfactory water solubility and defoaming property. In the case of adding an amount less than that required for neutralization of a carboxyl group, the condensation product of ricinoleic sulfide ends up being partially contained in the extreme-pressure additive of the present invention in the free state. On the other hand, in the case of adding an amount that is greater than that required for neutralization of a carboxyl group, the alkanol amine ends up being partially contained in the extreme-pressure additive of the present invention in the free state.

In the production of cutting liquid or grinding liquid from the extreme-pressure additive of the present invention, known oil agents, rust preventives, antimicrobials and defoaming agents may be used in combination. The extreme-pressure additive of the present invention may also be used by adding to a known, routinely used water-soluble cutting oil agent or water-soluble grinding oil agent.

A salt of a condensation product of hydroxy-unsaturated fatty acid like, for example, the alkaline metal salt or alkanol amine salt of a condensation product of ricinoleic acid can be used in combination with the extreme-pressure additive of the present invention.

A cutting liquid or grinding liquid containing the extreme-pressure additive of the present invention and water can be obtained from said extreme-pressure additive of the present invention.

In this extreme-pressure additive, although the effective blending ratio [based on weight (mass)] of the salt of a condensation product of sulfurized hydroxy-unsaturated fatty acid as claimed in the present invention is suitably selected according to the purpose and conditions of use, it is normally 1–50%, and preferably 1–10%, of an aqueous solution (cutting liquid or grinding liquid) that is actually applied during metal machining.

EXAMPLES

Although the following provides a more detailed explanation of the present invention using the following examples, the present invention is not limited to these examples. In the following examples, % refers to percent by weight (mass).

Synthesis Example 1

89.3 g of ricinoleic acid, 6.56 g of sulfur and 0.53 g of dicyclohexylamine as catalyst were charged into an autoclave. The apparatus was sealed and 3.60 g of hydrogen sulfide gas at 110° C. was allowed to flow in over the course of 15 hours at a pressure of 6 $Kg/cm^2$ (588 Pa). After cooling to 70° C., a valve connected to a hydrogen sulfide absorption apparatus was opened to return the pressure to normal pressure. Air was blown in from the blow tube to distill off the remaining hydrogen sulfide.

In this manner, 98.0 g of a condensation product of ricinoleic sulfide (product) was obtained in the form of a pale yellow liquid having a sulfur content of 9.8% (yield: 98%).

Synthesis Examples 2–4

Processing was performed in the same manner as Synthesis Example 1 with the exception of changing the reaction temperature to 120–130° C. and the duration of blowing in hydrogen sulfide to 4–12 hours in Synthesis Example 1.

Comparative Synthesis Example 1

Oleic sulfide was synthesized in the same manner as Synthesis Example 2 with the exception of using oleic acid instead of ricinoleic acid (as a typical example of an unsaturated long-chain fatty acid not containing a hydroxyl group). Although this oleic sulfide contained a structure corresponding to the previously mentioned sulfur-crosslinked structure (Y), it did not have an ester bond (X), which is the structure formed by condensation polymerization.

Comparative Synthesis Example 2

Condensed ricinoleic acid was synthesized by heating ricinoleic acid at 120° C. for 12 hours. Although this ricinoleic acid condensation polymerization product contained a structure corresponding to ester bond (X), which is the structure formed by the above condensation, it did not have the sulfur-crosslinked structure (Y).

The results and so forth of these synthesis examples and comparative synthesis examples are shown in Table 1.

TABLE 1

| | | Synthesis Examples | | | | Comparative Synthesis Examples | |
|---|---|---|---|---|---|---|---|
| | | 1 | 2 | 3 | 4 | 1 | 2 |
| | | Ricinoleic sulfide condensation products | | | | Oleic sulfide | Ricinoleic acid condensation product |
| Charged amount (mass %) | Ricinoleic acid | 89.3 | 89.3 | 89.3 | 89.3 | — | 100 |
| | Oleic acid | — | — | — | — | 89.3 | — |
| | Sulfur | 6.56 | 6.56 | 6.56 | 6.56 | 6.56 | — |
| | Hydrogen sulfide | 3.60 | 3.60 | 3.60 | 3.60 | 3.60 | — |
| | Amine catalyst | 0.53 | 0.53 | 0.53 | 0.53 | 0.53 | — |
| Hydrogen sulfide blowing conditions | Hydrogen sulfide blowing temp. (° C.) | 110 | 120 | 120 | 130 | 120 | — |
| | Hydrogen sulfide blowing time (Hr) | 15 | 6 | 12 | 4 | 8 | — |
| Heating reaction conditions | Reaction temp. (° C.) | — | — | — | — | — | 120 |
| | Reaction time (Hr) | — | — | — | — | — | 18 |
| Properties of formed product | Sulfur content (%) | 9.8 | 9.9 | 10.0 | 10.1 | 10 | 0 |
| | Kinetic viscos-ity @ 100° C. ($mm^2/s$) | 67.5 | 104.7 | 115.5 | 129.2 | 18 | 16.6 |
| | Color ASTM D-1500 | L3.5 | L3.5 | L3.5 | 4.0 | 4.5 | L1.5 |
| | Acid value mgKOH/g | 127.9 | 119.2 | 117.9 | 121.3 | 167 | 122.7 |
| | Hydroxy value mgKOH/g | 94.7 | 86.2 | 84.6 | 82.5 | 0 | 90.0 |
| | Appearance Room temp. | Pale yellow liquid | Pale yellow liquid | Pale yellow liquid | Pale yellow liquid | Dark red liquid | Pale yellow liquid |
| | Odor Room temp.*1 | ○ | ○ | ○ | ○ | Δ | ○ |

*1Odor evaluation: ○: Slight odor, Δ: Characteristic odor, X: Foul odor

Example 1

1.2 equivalents of triethanolamine were mixed with 1 equivalent of the condensation product of ricinoleic sulfide obtained in Synthesis Example 1 to form an amine salt (salt of the condensation product of sulfurized hydroxy-fatty acid) followed by adjusting to a 1–10% aqueous solution, and measuring load resistance (fused load, mean hertz load), wear resistance performance (abrasion mark diameter), lubrication performance (friction coefficient), water solubility, defoaming property and metal corrosion.

Example 2

1.2 equivalents of triethanolamine were mixed with 1 equivalent of the condensation product of ricinoleic sulfide obtained in Synthesis Example 2 to form an amine salt followed by testing performance in the same manner as Example 1.

Example 3

1.2 equivalents of triethanolamine were mixed with 1 equivalent of the condensation product of ricinoleic sulfide obtained in Synthesis Example 3 to form an amine salt followed by testing performance in the same manner as Example 1.

Example 4

1.9 equivalents of monoethanolamine were mixed with 1 equivalent of the condensation product of ricinoleic sulfide obtained in Synthesis Example 4 to form an amine salt followed by testing performance in the same manner as Example 1.

Example 5

3.3 equivalents of monoethanolamine were mixed with 1 equivalent of the condensation product of ricinoleic sulfide obtained in Synthesis Example 3 to form an amine salt followed by testing performance in the same manner as Example 1.

Example 6

1.9 equivalents of diethanolamine were mixed with 1 equivalent of the condensation product of ricinoleic sulfide obtained in Synthesis Example 3 to form an amine salt followed by testing performance in the same manner as Example 1.

Example 7

3.3 equivalents of diethanolamine were mixed with 1 equivalent of the condensation product of ricinoleic sulfide obtained in Synthesis Example 3 to form an amine salt followed by testing performance in the same manner as Example 1.

Example 8

1.9 equivalents of triethanolamine were mixed with 1 equivalent of the condensation product of ricinoleic sulfide obtained in Synthesis Example 3 to form an amine salt followed by testing performance in the same manner as Example 1.

Example 9

3.0 equivalents of triethanolamine were mixed with 1 equivalent of the condensation product of ricinoleic sulfide obtained in Synthesis Example 3 to form an amine salt followed by testing performance in the same manner as Example 1.

Comparative Example 1

1.6 equivalents of triethanolamine were mixed with 1 equivalent of the oleic sulfide of Comparative Synthesis Example 1 to form an amine salt followed by testing performance in the same manner as Example 1.

Comparative Example 2

3 equivalents of triethanolamine were mixed with 1 equivalent of the condensation product of ricinoleic acid of Comparative Synthesis Example 2 to form an amine salt followed by testing performance in the same manner as Example 1.

formation to 3 levels. Evaluation standards consisted of ○: no rust, Δ: formation of rust at several points, and X: formation of rust at numerous points.

The results of performance testing and measurement of various properties for the examples and comparative examples are shown in Tables 2 and 3.

TABLE 2

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Alkanol amine salt composition in equivalent ratio (mass ratio) | Syn. Ex. 1 | 1 (1) | | | | | | | | |
| | Syn. Ex. 2 | | 1 (1) | | | | | | | |
| | Syn. Ex. 3 | | | 1 (1) | 1 (1) | 1 (1) | 1 (1) | 1 (1) | 1 (1) | 1 (1) |
| | Monoethanolamine | | | | 1.9 (0.26) | 3.3 (0.45) | | | | |
| | Diethanolamine | | | | | | 1.9 (0.45) | 3.0 (0.71) | | |
| | Triethanolamine | 1.2 (0.45) | 1.2 (0.45) | 1.2 (0.45) | | | | | 1.9 (0.75) | 3.0 (1.18) |
| Load resistance | Fused load Kg | | | | | | | | | |
| | 1% aq. soln. | 95 | 95 | 85 | 110 | 110 | 90 | 85 | 95 | 90 |
| | 2.5% aq. soln. | 135 | 150 | 180 | 150 | 155 | 155 | 145 | 130 | 120 |
| | 10% aq. soln. | 220 | 210 | 205 | 280 | 240 | 205 | 200 | 210 | 190 |
| | Mean hertz load | | | | | | | | | |
| | 10% aq. soln. | 76.4 | 73.2 | 73.0 | 63.0 | 62.2 | 52.9 | 53.8 | 73.2 | 68.6 |
| Wear resistance | Abrasion mark diameter mm | | | | | | | | | |
| | 1% aq. soln. | 0.63 | 0.67 | 0.76 | 0.78 | 0.92 | 0.96 | 0.57 | 0.80 | 0.66 |
| | 10% aq. soln. | 0.62 | 0.61 | 0.76 | 0.85 | 0.97 | 0.93 | 0.79 | 0.61 | 0.60 |
| Friction coefficient | Soda-pendulum type friction coefficient $\mu$ 1% aq. soln. | 0.104 | 0.105 | 0.101 | 0.132 | 0.120 | 0.115 | 0.103 | 0.105 | 0.095 |
| Water solubility | Appearance of 10% aq. soln. | ◎ | ◎ | ◎ | Δ | ○ | ◎ | ◎ | ◎ | ◎ |
| Defoaming | Residual foam (ml) | | | | | | | | | |
| property | 1% aq. soln. | Δ | Δ | Δ | ○ | ○ | ◎ | ◎ | ◎ | ◎ |
| | After 60 min. | 275 | 250 | 200 | 130 | 90 | 30 | 50 | 20 | 0 |
| Metal corrosion | Iron corrosion 1% aq. soln. | ○ | ○ | ○ | ○ | ○ | ○ | ○ | ○ | ○ |

Load resistance was evaluated by measuring fused load and mean hertz load using a high-speed four-ball EP tester based on ASTM D2783 under conditions of room temperature, 1770 rpm and 10 seconds.

Wear resistance performance was evaluated by measuring abrasion mark diameter using a high-speed four-ball wear tester based on ASTM D4172 under conditions of 75° C., 1200 rpm, 40 kg and 60 minutes.

Lubrication performance was evaluated by measuring kinetic friction coefficient using a Soda-pendulum type friction tester under conditions of room temperature and 0.5 radians.

Water solubility was evaluated by dissolving an amine salt sample in 10% water and assessing transparency to five levels. Evaluation standards consisted of ◎: completely transparent, ○: transparent, Δ: slightly turbid, X: turbid, and X X: biphasic separation.

Defoaming property was evaluated by placing 200 ml of a 1% aqueous solution of amine salt sample in a 500 ml graduated cylinder, shaking for 30 seconds and measuring the amount of foam remaining (ml) after 60 minutes.

Metal corrosion was evaluated by half-immersing a piece of iron for one month in 100 ml of a 1% aqueous solution of amine salt sample, and assessing the degree of rust

TABLE 3

| | | Comp. Ex. 1 Oleic sulfide salt | Comp. Ex. 2 Ricinoleic acid condensation product salt |
|---|---|---|---|
| Alkanol amine salt composition (equivalent ratio) | Comp. Syn. Ex. 1 | 1 (1) | |
| | Comp. Syn. Ex. 2 | | 1 (1) |
| | Triethanolamine | 1.6 (0.71) | 3 (0.79) |
| Load resistance | Fused load kg | | |
| | 1% aq. soln. | 115 | 55 |
| | 2.5% aq. soln. | 160 | 75 |
| | 10% aq. soln. | 185 | 80 |
| | Mean hertz load | | |
| | 10% aq. soln. | 65.5 | 21.6 |
| Wear resistance | Abrasion mark diameter mm | | |
| | 1% aq. soln. | 0.57 | 0.64 |
| | 10% aq. soln. | 0.80 | 0.67 |
| Friction coefficient | Soda-pendulum type friction coefficient $\mu$ 1% aq. soln. | 0.108 | 0.104 |
| Water solubility | Appearance of 10% aq. soln. | Δ | Δ |

TABLE 3-continued

| | | Comp. Ex. 1 Oleic sulfide salt | Comp. Ex. 2 Ricinoleic acid condensation product salt |
|---|---|---|---|
| Defoaming property | Amount of residual foam ml 1% aq. soln. after 60 min. | X | ⊙ |
| | | 400 | 50 |
| Metal corrosion | Iron corrosion 1% aq. soln. | ○ | ○ |

As is indicated in these tables, the extreme-pressure additive of the present invention comprising a salt of a condensation product of ricinoleic sulfide is completely soluble in water, has only a slight odor and pale color, and an aqueous solution thereof has superior defoaming property and rust preventive characteristics. In addition, the extreme-pressure additive of the present invention also has an extremely superior load resistance and lubricity.

INDUSTRIAL APPLICABILITY

According to the present invention, a sulfur-based extreme-pressure additive can be provided that is completely soluble in water without using a surfactant, and has satisfactory odor and hue. A cutting liquid and grinding liquid are also provided having superior defoaming property and rust preventive characteristics, while also having high load resistance and lubrication performance comparable to cutting oils and grinding oils of the prior art.

What is claimed is:

1. An extreme-pressure additive comprising a salt of a condensation product of a sulfurized hydroxy-unsaturated fatty acid; wherein, said condensation product has a sulfur content of 8 to 15% by weight (mass), color of 6 or less, and acid value of 80 to 200.

2. The extreme-pressure additive according to claim 1 wherein, said hydroxy-unsaturated fatty acid is ricinoleic acid.

3. The extreme-pressure additive according to claim 2 wherein, the acid value of said sulfurized condensation product is 100 to 160.

4. The extreme-pressure additive according to any of claims 1, 2 or 3 wherein, the salt is an alkanol amine salt or alkaline metal hydroxide salt.

5. A production method of an extreme-pressure additive comprising:

reacting hydroxy-unsaturated fatty acid, sulfur and hydrogen sulfide while heating and applying pressure, and sulfurizing and condensing the hydroxy-unsaturated fatty acid followed by neutralizing the resulting reaction product with base.

6. The production method of an extreme-pressure additive according to claim 5 wherein, the reaction pressure is within the range of 98 to 2940 kPa.

7. The production method of an extreme-pressure additive according to either of claims 5 or 6 wherein, the reaction temperature is from 100 to 160° C.

8. A cutting liquid comprising the extreme-pressure additive according to any of claims 1 through 3 and water.

9. A grinding liquid comprising the extreme-pressure additive according to any of claims 1 through 3 and water.

* * * * *